United States Patent [19]

Sasaki et al.

[11] Patent Number: 4,564,590

[45] Date of Patent: Jan. 14, 1986

[54] SILVER HALIDE PHOTOGRAPHIC MATERIAL

[75] Inventors: Masao Sasaki; Toyoki Nishijima; Shun Takada; Takashi Kadowaki; Kaoru Onodera, all of Odawara, Japan

[73] Assignee: Konishiroku Photo Industry Co., Ltd., Tokyo, Japan

[21] Appl. No.: 713,474

[22] Filed: Mar. 19, 1985

[30] Foreign Application Priority Data

Mar. 29, 1984 [JP] Japan ..... 59-62886

[51] Int. Cl.[4] ..... G03C 7/26

[52] U.S. Cl. ..... 430/551; 430/505; 430/552; 430/553

[58] Field of Search ..... 430/551, 552, 553, 505

[56] References Cited

U.S. PATENT DOCUMENTS

| | | | |
|---|---|---|---|
| 3,772,002 | 11/1973 | Ramello | 430/553 |
| 4,217,410 | 8/1980 | Nakamura et al. | 430/551 |
| 4,277,558 | 7/1981 | Kikuchi et al. | 430/551 |
| 4,451,558 | 5/1984 | Sugita et al. | 430/553 |
| 4,518,683 | 5/1985 | Kato et al. | 430/552 |

*Primary Examiner*—J. Travis Brown

*Attorney, Agent, or Firm*—Jordan B. Bierman

[57] ABSTRACT

A silver halide photographic material having one or more silver halide emulsion layers formed on a reflective support is disclosed, wherein at least one of the silver halide emulsion layers contains at least one cyan coupler of formula (I) dispersed therein with the aid of at least one high-boiling organic solvent having a dielectric constant of 6.1 or more, and wherein at least one photographic layer contains at least one dye of formula (II) and/or formula (III):

(I)

wherein $R_1$ is a straight- or branched-chain alkyl group having 2 to 4 carbon atoms; $R_2$ is a ballast group; and X is a hydrogen atom or a group capable of leaving upon coupling reaction with the oxidized product of a color developing agent;

(II)

wherein $R_3$ and $R_5$ are each a hydrogen atom, an alkyl group or an aryl group; $R_4$ and $R_6$ are each an aryl group or a hetero ring having at least one sulfonic acid group or carboxyl group either directly or via an alkylene group having 1 to 4 carbon atoms; and n is an integer of 0, 1 or 2;

(III)

wherein $R_7$, $R_{10}$, $R_{11}$ and $R_{14}$ are each a hydrogen atom, a hydroxyl group, —OR (wherein R is alkyl or aryl), (wherein R′ and R″ are each a hydrogen atom or an alkyl or aryl group having at least one sulfonic acid group or carboxyl group); $R_8$, $R_9$, $R_{12}$ and $R_{13}$ are each a hydrogen atom, a sulfonic acid group, a carboxyl group, or an alkyl or aryl group having at least one sulfonic acid group or carboxyl group.

6 Claims, No Drawings

SILVER HALIDE PHOTOGRAPHIC MATERIAL

BACKGROUND OF THE INVENTION

The present invention relates to a silver halide photographic material. More particularly, the invention relates to a silver halide photographic material which contains a cyan coupler having high resistance to discoloration in the dark and which is also improved in terms of color formation and resistance to discoloration under light.

The mechanism behind the formation of dye images in a silver halide color photographic material is that an aromatic primary amine developing agent is oxidized while reducing silver halide grains in the exposed photographic material and the resulting oxidized product reacts with a coupler already present in the silver halide color photographic material so as to form a dye. Color reproduction in this case depends commonly on the subtractive process using three couplers which respectively form yellow, magenta and cyan dyes.

There are several requirements that must be met by the couplers: first, they must have high solubility in high-boiling organic solvents, and they should be highly dispersible in silver halide emulsions and the prepared dispersion should remain stable without causing the precipitation of the couplers; secondly, the couplers should have good spectral absorption characteristics and improved tones, so that they provide sharp dye images in a wide color reproduction region; and thirdly, the couplers should produce dye images which are highly resistant to light, heat and moisture. Cyan couplers are particularly required to have a good balance among their dye image keeping properties including resistance to light, heat and moisture.

U.S. Pat. No. 2,801,171 discloses 6-[α-(2,4-di-tert-amylphenoxy)butaneamido]-2,4-di-chloro-3-methylphenol. This cyan coupler produces an image having high resistance to light discoloration, but its resistance to dark discoloration is low. Furthermore, this coupler depends highly on benzyl alcohol for color development and is not suitable for the purpose of non-polluting processing.

Typical known cyan couplers are 2,5-diacylaminophenol compounds having an acylamino group as a substituent on the 2- and 5-positions of the phenol ring, and cyan couplers of this type are shown in U.S. Pat. No. 2,895,826, as well as in Japanese Unexamined Published Patent Application Nos. 112038/1975, 109630/1978 and 163537/1980. Such 2,5-diacylaminophenolic cyan couplers are extensively used since they produce cyan dye images having high resistance to dark discoloration. However, the resistance to light discoloration of the produced dye image is extremely low, and the unreacted cyan coupler is highly likely to turn yellow upon exposure to light (this phenomenon is hereunder referred to as Y stain under light).

U.S. Pat. No. 3,772,002 discloses 6-[α-(2,4-di-tert-amylphenoxy)butaneamido]-2,4-di-chloro-3-ethylphenol as a coupler capable of producing an image having high resistance to dark discoloration, but it still depends highly on benzyl alcohol for color development and if it is processed with a color developer containing no benzyl alcohol, sufficient color formation is not ensured. This coupler also has low resistance to light discoloration.

The present inventors previously found that if a phenolic cyan coupler is dispersed in a silver halide emulsion with the aid of a high-boiling organic solvent having a dielectric constant of 6.1 or more (e.g. dibutyl phthalate), the color formation resulting from processing with a color developer containing no benzyl alcohol can be improved. While this method is fairly effective in improving the color formation on a photographic material processed with a benzyl alcohol free color developer, Y stain under light (yellowing of the white background which is presumably due to the presence of the unreacted cyan coupler) is increased to an undesired degree.

SUMMARY OF THE INVENTION

One object of the present invention, therefore, is to provide a silver halide photographic material containing a phenolic cyan coupler that has high resistance to both dark and light discolorations and which exhibits improved color formation with a color developer containing no benzyl alcohol.

Another object of the present invention is to provide a silver halide photographic material containing a phenolic cyan coupler which is less likely to cause Y stain under light and which therefore ensures sufficient protection of the white background from discoloration.

These objects can be achieved by a silver halide photographic material having one or more silver halide emulsion layer formed on a reflective support, wherein at least one of said silver halide emulsion layers contains at least one cyan coupler of formula (I) dispersed therein with the aid of at least one high-boiling organic solvent having a dielectric constant of 6.1 or more, and wherein at least one photographic layer contains at least one dye of formula (II) and/or formula (III):

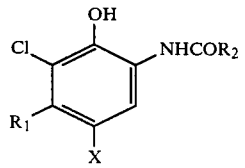

(I)

(wherein $R_1$ is a straight- or branched-chain alkyl group having 2 to 4 carbon atoms; $R_2$ is a ballast group; and X is a hydrogen atom or a group capable of leaving upon coupling reaction with the oxidized product of a color developing agent);

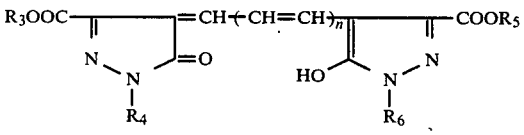

(II)

(wherein $R_3$ and $R_5$ are each a hydrogen atom, an alkyl group or an aryl group; $R_4$ and $R_6$ are each an aryl group or a hetero ring having at least one sulfonic acid group or carboxyl group either directly or via an alkylene group having 1 to 4 carbon atoms; and n is an integer of 0, 1 or 2);

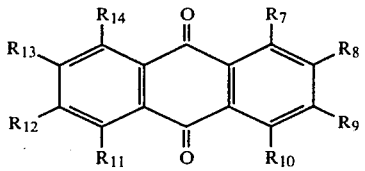

(III)

[wherein $R_7$, $R_{10}$, $R_{11}$ and $R_{14}$ are each a hydrogen atom, a hydroxyl group, —OR (wherein R is an alkyl or aryl),

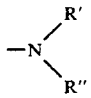

(wherein R' and R'' are each a hydrogen atom or an alkyl or aryl group having at least one sulfonic acid group or carboxyl group); $R_8$, $R_9$, $R_{12}$ and $R_{13}$ are each a hydrogen atom, a sulfonic acid group, a carboxyl group, or an alkyl or aryl group having at least one sulfonic acid group or carboxyl group].

DESCRIPTION OF THE PREFERRED EMBODIMENT

The phenolic cyan coupler useful in the present invention is selected from among the compounds represented by formula (I).

The symbol $R_1$ in formula (I) represents a straight- or branched-chain alkyl group having 2 to 4 carbon atoms, such as ethyl, propyl or butyl. These alkyl groups may have substituents but unsubstituted alkyl groups are preferred. An unsubstituted ethyl group is particularly preferred. Illustrative substituents are acylamino and alkoxy groups.

The symbol X in formula (I) represents a group that leaves upon coupling reaction with the oxidized product of a color developing agent, and as is well known in the art, such group determines not only the equivalent number of a particular coupler but also the reactivity of the coupling reaction. Typical examples of such group include a halogen (e.g. chlorine or fluorine), an aryloxy group, an alkoxy group, an acyloxy group, a sulfonamido group, an arylthio group, a heteroylthio group, a heteroyloxy group, a sulfonyloxy group and a carbamoyloxy group. Such groups may be substituted or unsubstituted.

More specific examples of the group capable of leaving upon coupling reaction are shown in Japanese Unexamined Published Patent Application Nos. 10135/1975, 120334/1975, 18315/1977, 52423/1978, 117422/1975, 130441/1975, 66129/1979, 48237/1979, 146828/1976, 14736/1979, 37425/1972, 123341/1975, 95346/1983, Japanese Patent Publication No. 36894/1973, U.S. Pat. Nos. 3,476,563, 3,737,316 and 3,227,551.

The symbol $R_2$ in formula (I) represents a ballast group which is an organic group having such a size and shape that can provide a coupler molecule with sufficient bulkiness to substantially prevent its diffusion from the layer where said coupler is incorporated to another layer. Typical ballast groups are alkyl and aryl groups having a total of 8 to 32 carbon atoms. Such alkyl and aryl groups may have substituents; substituents for aryl groups include alkyl, aryl, alkoxy, aryloxy, carboxy, acyl, ester, hydroxy, cyano, nitro, carbamoyl, carbonamido, alkylthio, arylthio, sulfonyl, sulfonamido, sulfamoyl and halogen, and such substituents excepting alkyl may also be used as substituents for alkyl groups.

Preferred ballast groups are represented by the following formula:

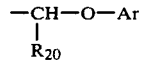

wherein $R_{20}$ is a hydrogen atom or an alkyl group having 1 to 12 carbon atoms; and Ar is an aryl group such as phenyl, which may be substituted by, for example, an alkyl, hydroxy, or alkylsulfonamido, with a branched-chain alkyl group such as t-butyl being preferred.

Typical examples of the phenolic cyan coupler of formula (I) are listed below.

Exemplary compound

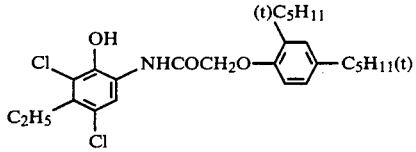

(I-1)

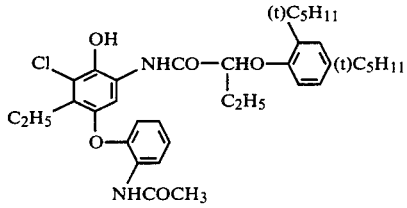

(I-2)

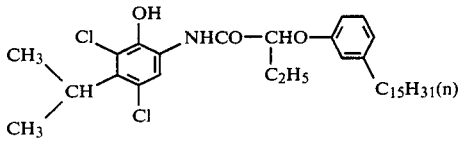

(I-3)

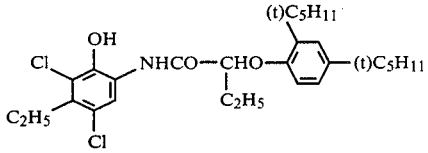

(I-4)

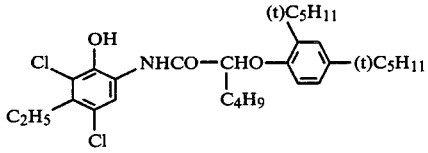

(I-5)

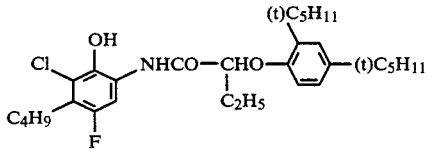

(I-6)

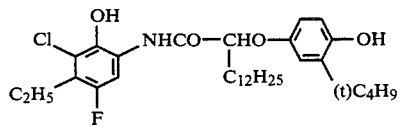

(I-7)

-continued (I-8)

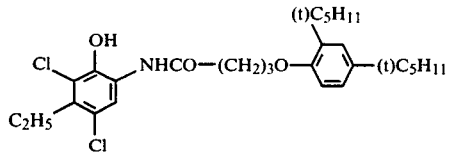

(I-9)

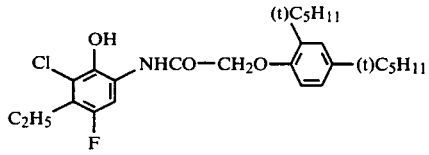

(I-10)

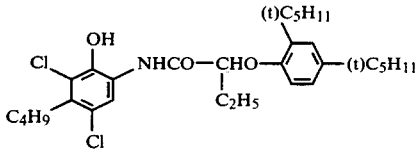

(I-11)

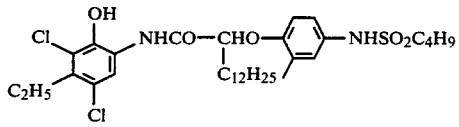

(I-12)

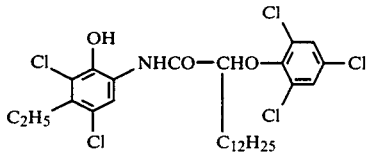

(I-13)

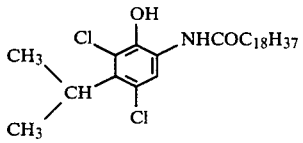

(I-14)

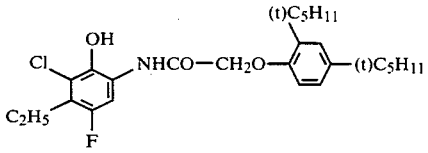

(I-15)

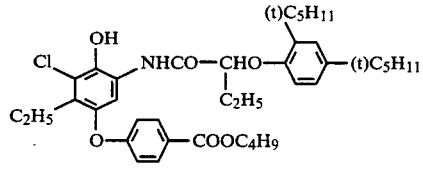

(I-16)

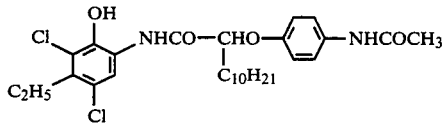

(I-17)

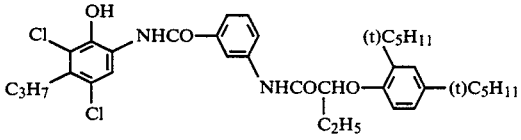

-continued (I-18)

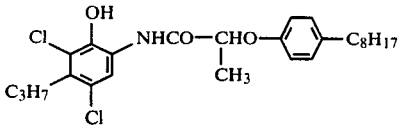

(I-19)

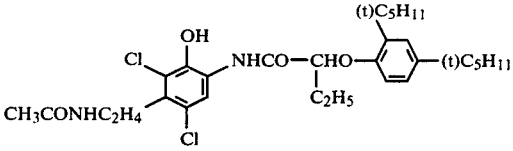

(I-20)

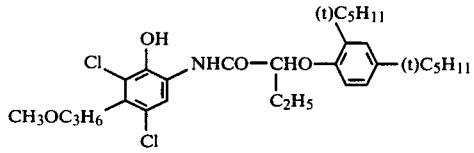

Exemplary compound No. I-1 as a cyan coupler according to the present invention can be produced by the following method, which may be properly modified and applied to the preparation of other exemplary compounds.

(1)-a: Preparation of 2-nitro-4,6-dichloro-5-ethylphenol

A mixture of 2-nitro-5-ethylphenol (33 g), iodine (0.6 g) and ferric chloride (1.5 g) was dissolved in glacial acetic acid (150 ml). To the resulting solution, 75 ml of sulfuryl chloride was added dropwise at 40° C. over a period of 3 hrs. The precipitate formed during the dropwise addition of sulfuryl chloride was dissolved by refluxing which was effected after completion of the addition. The refluxing was continued for about 2 hrs. The reaction solution was poured into water and the resulting crystal was purified by recrystallization from methanol. The crystal was identified as compound (1)-a by NMR and elemental analyses.

(1)-b: Preparation of 2-amino-4,6-dichloro-5-ethylphenol

Compound (1)-a (21.2 g) was dissolved in 300 ml of alcohol. A catalytic amount of Raney nickel was added to the solution and hydrogen was bubbled into the solution at atmospheric pressure until the absorption of hydrogen ceased. After completion of the reaction, the Raney nickel was removed and the alcohol was distilled off under vacuum. The residual (1)-b compound was subjected to the subsequent acylation without purification.

(1)-c: Preparation of 2-[(2,4-di-tert-amylphenoxy)acetamido]-4,6-dichloro-5-ethylphenol The crude amino compound (1)-b (18.5 g) was dissolved in a liquid mixture of glacial acetic acid (500 ml) and sodium acetate (16.7 g). To the resulting solution was added dropwise a solution of 2,4-di-tert-aminophenoxyacetic acid chloride (28.0 g) in acetic acid (50 ml) at room temperature over a period of 30 minutes. Following stirring for an additional 30 minutes, the reaction solution was poured into iced water. The resulting crystal was recovered by filtration and dried. Two recrystallizations with acetonitrile gave the end compound. It was identified as (1)-c by elemental and NMR analyses.

| Elemental analysis for $C_{26}H_{35}NO_3Cl_2$ | | | | |
|---|---|---|---|---|
| | C | H | N | Cl (%) |
| Calculated: | 65.00 | 7.34 | 2.92 | 14.76 |
| Found: | 64.91 | 7.36 | 2.99 | 14.50 |

The phenolic cyan couplers of formula (I) according to the present invention are incorporated in emulsions by dispersing them with the aid of at least one of the high-boiling organic solvents having dielectric constants not lower than 6.1.

The high-boiling organic solvents having dielectric constants not lower than 6.1 and which are preferably used in the present invention are dialkyl phthalates of formula (IV) or phosphate esters of formula (V):

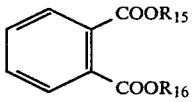

(IV)

(wherein $R_{15}$ and $R_{16}$ are each an alkyl group having 1 to 4 carbon atoms);

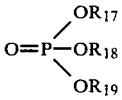

(V)

[wherein $R_{17}$, $R_{18}$ and $R_{19}$ are each an alkyl group having 1 to 4 carbon atoms or an aryl group (e.g. phenyl)].

The groups represented by $R_{15}$ to $R_{19}$ may have substituents.

Typical examples of the organic solvents that are represented by formulas (IV) and (V) are listed below.

Exemplary compound:

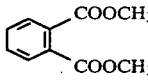

(IV-1)

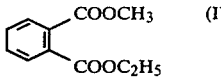

(IV-2)

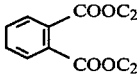

(IV-3)

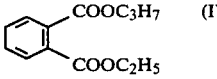

(IV-4)

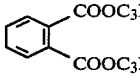

(IV-5)

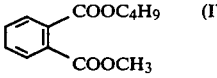

(IV-6)

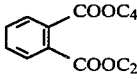

(IV-7)

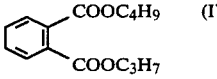

(IV-8)

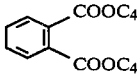

(IV-9)

-continued

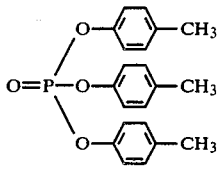

(V-1)

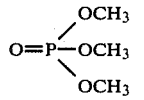

(V-2)

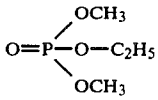

(V-3)

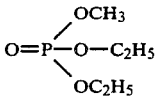

(V-4)

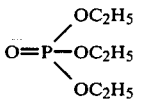

(V-5)

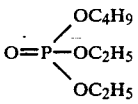

(V-6)

Other high-boiling organic solvents having dielectric constants not lower than 6.1 include diethyl malonate, diethyl maleate, γ-butyrolactone, methyl benzoate, benzyl alcohol and 1-octanol.

The above listed high-boiling organic solvents according to the present invention may be used in combination with ethyl acetate and other known low-boiling organic solvents.

The cyan couplers of the present invention, either alone or in admixture, are dissolved in the high-boiling organic solvents having dielectric constants not lower than 6.1, which may be used individually or as mixtures with themselves or with low-boiling organic solvents; then, the resulting solution is mixed with an aqueous gelatin solution containing a surfactant; the mixture is subsequently dispersed in a high-speed rotary mixer, colloid mill or an ultrasonic disperser, and silver halide grains are added to the resulting dispersion so as to prepare a silver halide emulsion for use in the present invention.

The cyan coupler according to the present invention is incorporated in a silver halide emulsion typically in an amount of about 0.05–2 moles, preferably 0.1–1 mole, per mol of silver halide. The organic solvent according to the present invention is used in an amount of 25–150 wt%, preferably 50–100 wt%, of the cyan coupler of the present invention.

According to another feature of the present invention, at least one of the dyes represented by formula (II) and/or formula (III) is incorporated in at least one of the photographic layers constituting the silver halide photographic material of the present invention. The photographic layers as used herein include not only the silver halide emulsion layer shown above but also non-sensitive auxiliary layers such as a filter layer, an intermediate layer, a protective layer, an antihalation layer and a subbing layer.

Preferred dyes of formula (II) are such that $R_3$ and $R_5$ each represents a hydrogen atom, or an alkyl group, preferably a lower alkyl group (e.g. methyl or ethyl); the hetero ring represented by $R_{14}$ and $R_6$ of formula (II) may be condensed by a ring such as a benzene ring; and n is an integer of 1 or 2.

Typical examples of the dyes represented by formula (II) are listed below.

Exemplary compounds:

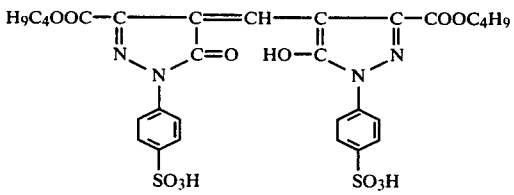
(II-1)
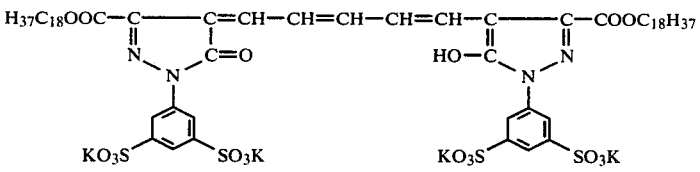
(II-2)
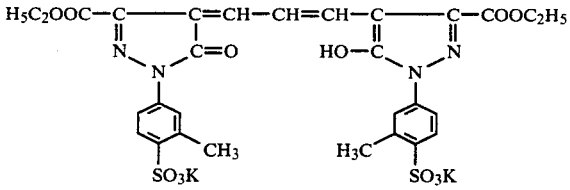
(II-3)
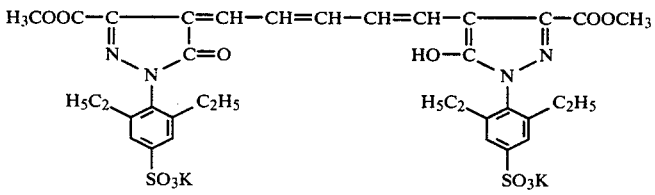
(II-4)
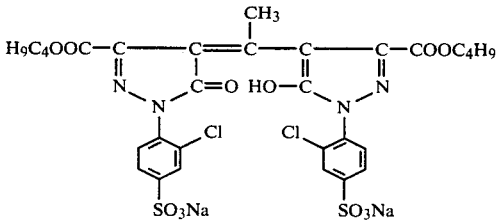
(II-5)
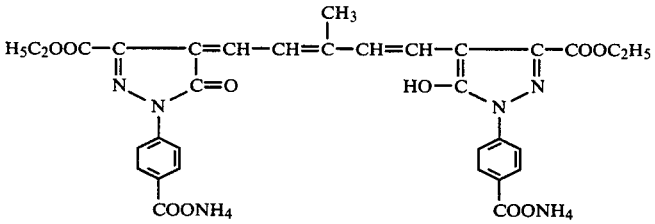
(II-6)
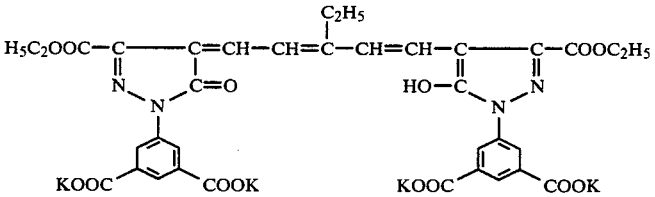
(II-7)

-continued
(II-8)
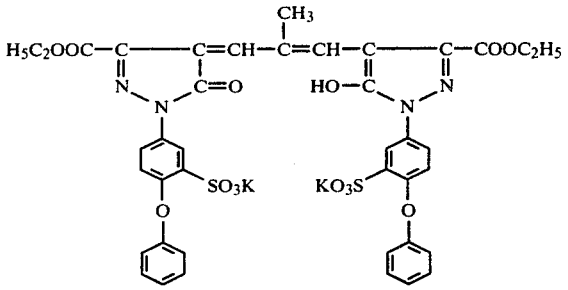
(II-9)
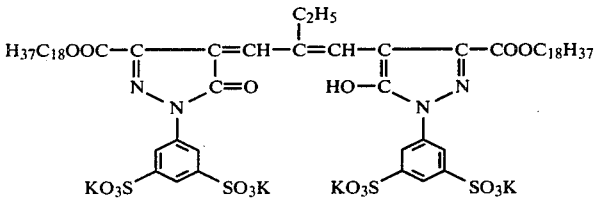
(II-10)
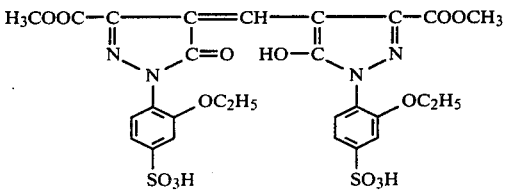
(II-11)
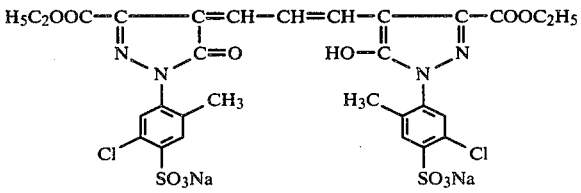
(II-12)
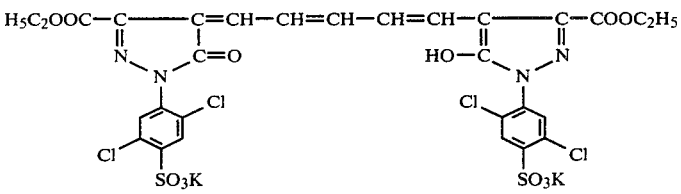
(II-13)
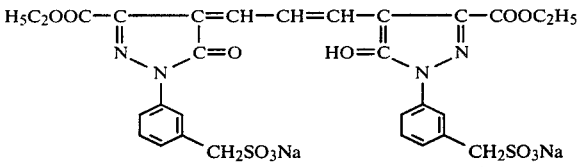
(II-14)
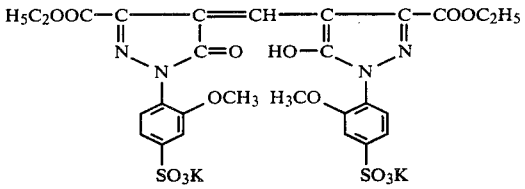
(II-15)
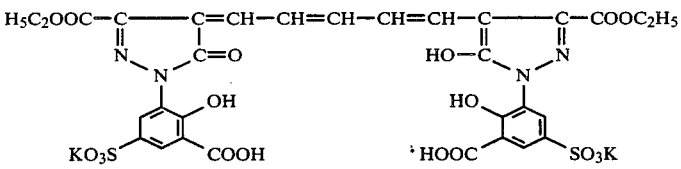
(II-16)
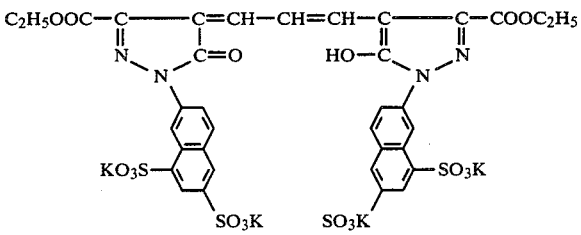

-continued
(II-17)
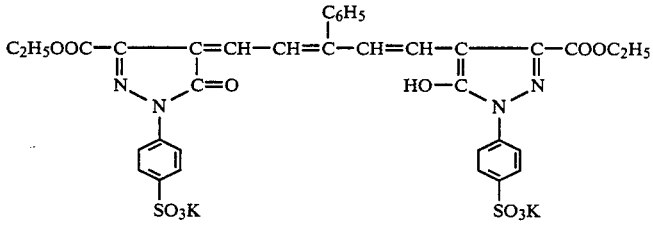
(II-18)
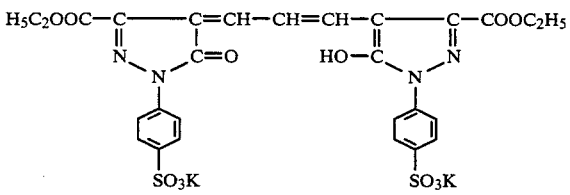
(II-19)
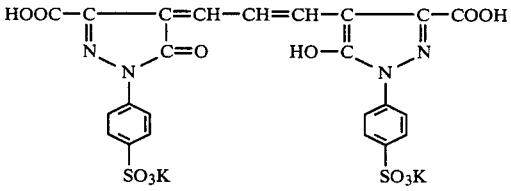
(II-20)
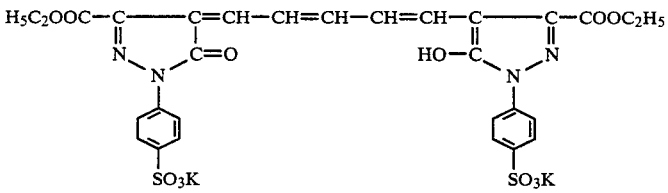
(II-21)
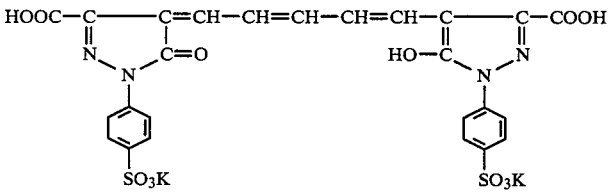
(II-22)
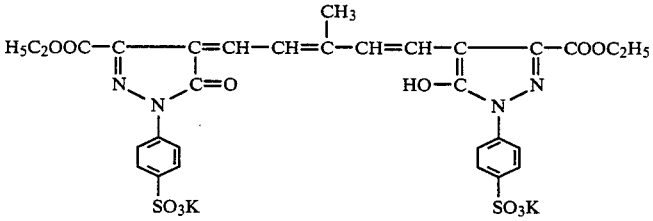
(II-23)
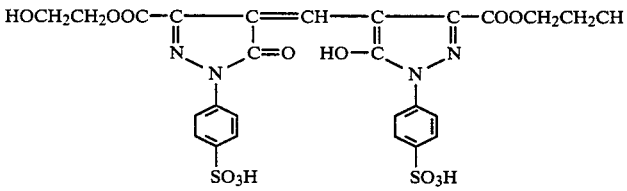
(II-24)
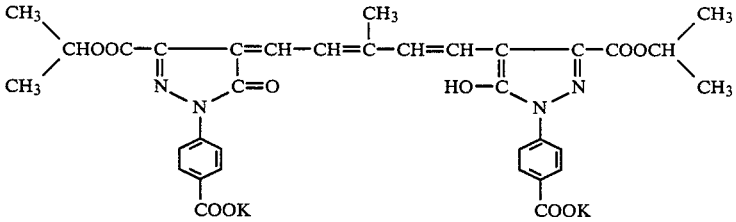

-continued
(II-25)
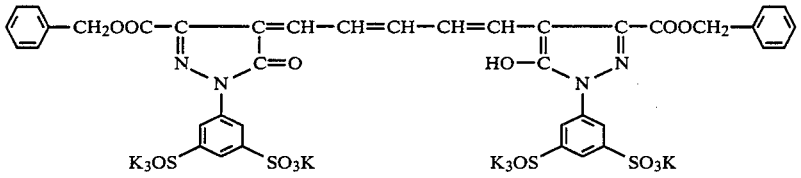
(II-26)
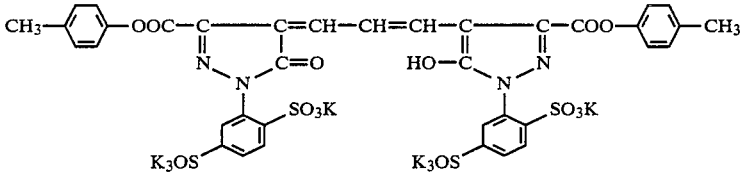
(II-27)
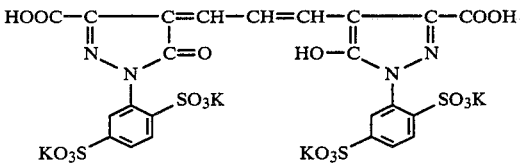
(II-28)
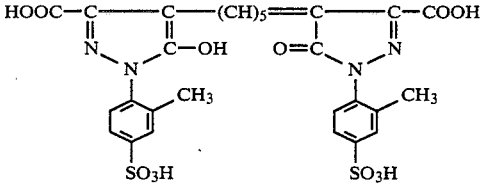
(II-29)
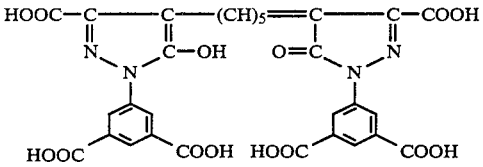
(II-30)
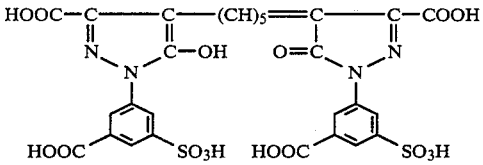
(II-31)
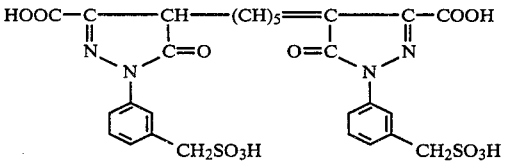
(II-32)
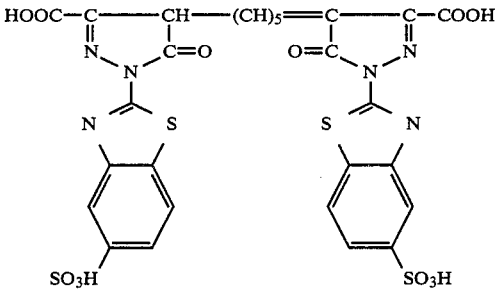
(II-33)
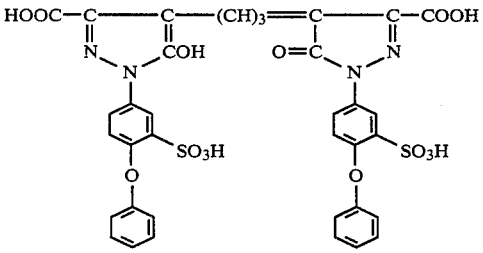
(II-34)
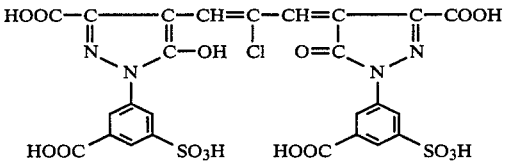
(II-35)
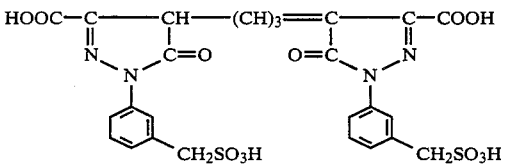
(II-36)
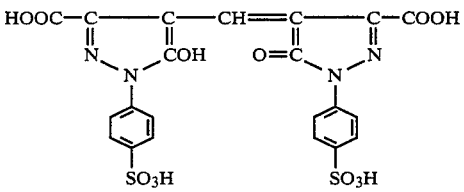

-continued (II-37)

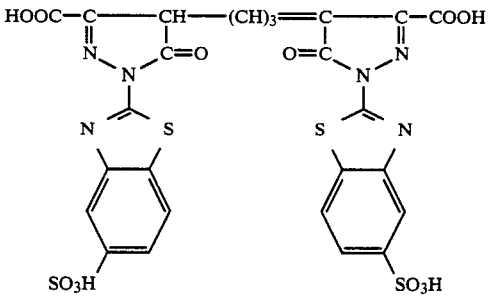

The dyes of formula (II) may be prepared by the methods shown in Japanese Patent Publication Nos. 46607/1976 and 22069/1964. These dyes are first dissolved in water or a water-miscible organic solvent such as ethanol, methanol or acetone; then, the solution is added to a hydrophilic colloidal binder that is to make up a photographic layer, and the resulting mixture is applied as a layer.

The dyes of formula (III) are such that $R_7$, $R_{10}$, $R_{11}$ and $R_{14}$ may each represent OR wherein R is an alkyl or aryl group; preferred alkyl groups are methyl and ethyl, and a preferred aryl group is phenyl. In formula (III), $R_7$, $R_{10}$, $R_{11}$ and $R_{14}$ may also represent

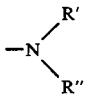

wherein R′ or R″ represents an alkyl or aryl group having at least one sulfonic acid or carboxyl group; preferred examples of such alkyl or aryl group include —$CH_2$—$SO_3Na$, —$CH_2CH_2$—$SO_3Na$, —$CH_2$—COONa, —$CH_2CH_2$—COONa,

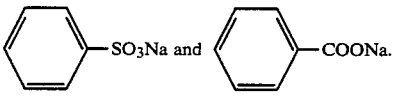

The symbols $R_8$, $R_9$, $R_{12}$ and $R_{13}$ in formula (III) may represent an alkyl or aryl group having at least one sulfonic acid or carboxyl group, and preferred examples of such groups are —$CH_2$—$SO_3Na$, —$CH_2$—COONa,

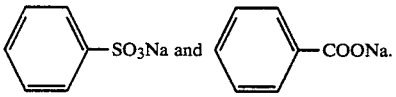

Typical examples of the dyes represented by formula (III) are listed below.

Exemplary Compounds:

(III-1)

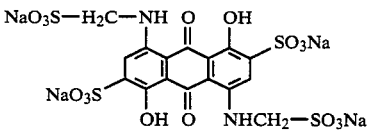

-continued (III-2)

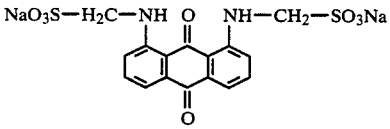

(III-3)

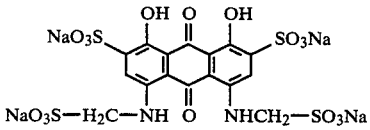

(III-4)

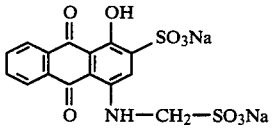

(III-5)

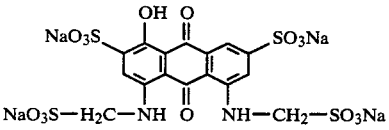

(III-6)

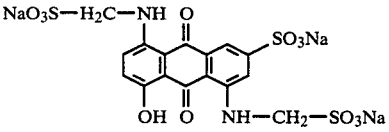

(III-7)

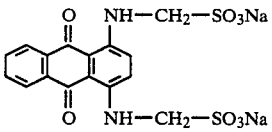

(III-8)

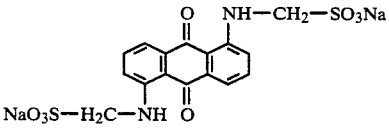

(III-9)

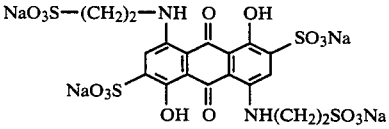

-continued (III-10)

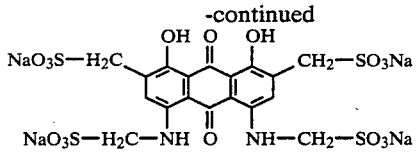

(III-11)

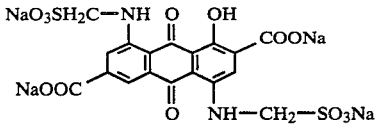

(III-12)

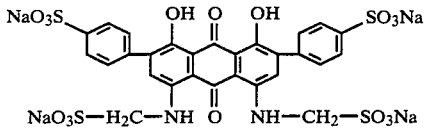

(III-13)

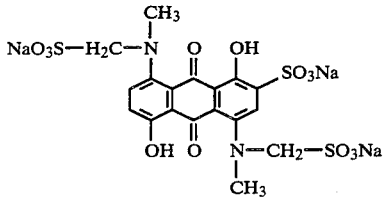

(III-14)

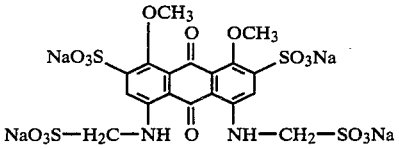

(III-15)

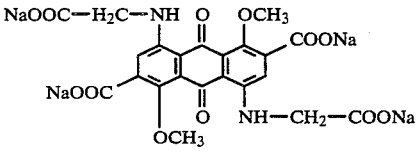

(III-16)

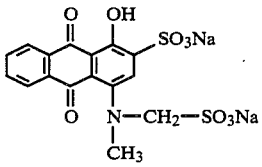

(III-17)

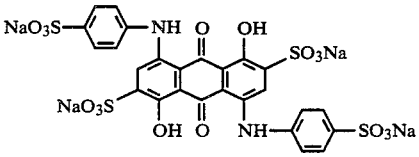

(III-18)

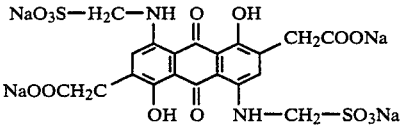

(III-19)

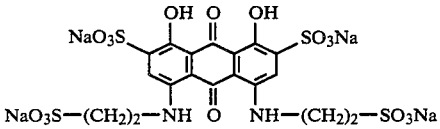

The dyes of formula (III) are shown in U.S. Pat. No. 2,865,752 and may be produced by the methods shown in British Pat. No. 238,717 and German Pat. No. 462,041. These dyes may be incorporated in photographic layers by the method which is identical to that shown with regard to the dyes of formula (II).

The dyes according to the present invention are preferably used in combination with themselves; for example, a dye of formula (II) wherein n is 1 may be combined with a dye of formula (II) wherein n is 2, or alternatively, a dye of formula (II) wherein n is 1 may be combined with a dye of formula (III).

The dyes of formula (II) or (III) may be incorporated in any of the photographic layers used in the present invention, but preferably, they may be incorporated in a red-sensitive silver halide emulsion layer.

Each of the compounds of formulas (II) and (III) is typically used in an amount of 1–100 mg/m$^2$, preferably 5–50 mg/m$^2$. If more than two of the compounds of formula (II) or (III) are used in combination, the sum of their amounts generally ranges from 1 to 300 mg/m$^2$, preferably from 5 to 100 mg/m$^2$.

The silver halide photographic material of the present invention may assume any layer arrangement so long as it has at least one silver halide emulsion layer formed on a support. There is no particular limitation either on the number of the silver halide emulsion layers and non-sensitive layers or on the order in which such layers are arranged. Typical examples of the silver halide photographic material of the present invention include color positive or negative films, color papers, color slides, as well as specialty photosensitive materials for printing, X-ray photography or high-resolution photography. The photographic material of the present invention is particularly suitable for use as a color paper. Typically, most of the silver halide emulsion layers and non-sensitive layers are formed as hydrophilic colloidal layers containing hydrophilic binders. Such hydrophilic binders are preferably made of gelatin, or gelatin derivatives such as acylated gelatin, guanidylated gelatin, carbamylated gelatin, cyanoethanolated gelatin and esterified gelatin.

Methods used with conventional cyan dye forming couplers can equally be used with the cyan coupler of formula (I) according to the present invention. A silver halide emulsion layer that contains the cyan coupler of the present invention is formed on a support, thereby providing the intended silver halide photographic material of the present invention.

The silver halide photographic material of the present invention may be used in either monochromatic or multi-color photography. With a multi-color silver halide photographic material, the cyan coupler according to the present invention is usually incorporated in a red-sensitive silver halide emulsion layer, but instead, it may be incorporated in a non-sensitive emulsion layer or an emulsion layer having sensitivity to light in the spectral regions of the three primary colors other than red. Each of the photographic units that are responsible for the formation of dye images in the present invention is made of one or more emulsion layers that have sensitivity to light in certain spectral regions.

If the silver halide photographic material of the present invention is a multi-color element, the layers necessary for making the photographic element including the image forming units shown above may be arranged in any of the orders known in the art. A typical multi-color silver halide photographic material comprises a support which carries a cyan dye image forming unit having at least one red-sensitive silver halide emulsion layer containing one or more cyan dye forming couplers (at least one of the cyan dye forming couplers incorporated in the emulsion layer is the cyan coupler represented by formula (I)), a magenta dye image forming unit having at least one green-sensitive silver halide emulsion layer containing at least one magenta dye forming coupler, and a yellow dye image forming unit having at least one blue-sensitive silver halide emulsion layer containing at least one yellow dye forming coupler.

The photographic element may contain additional non-sensitive layers such as a filter layer, an intermediate layer, a protective layer, an anti-halation layer and a subbing layer.

Tyical examples of the yellow and magenta dye forming couplers that may be preferably used in the present invention are listed below.

Yellow couplers:

Y-1

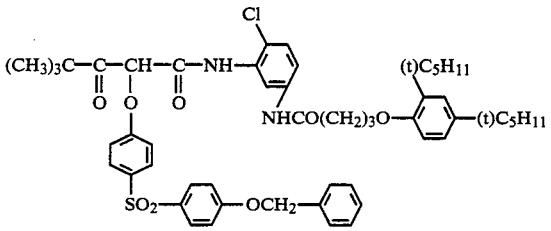

Y-2

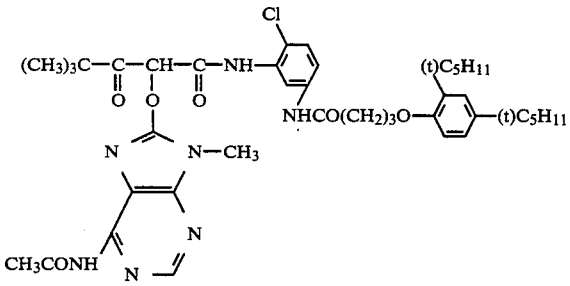

Y-3

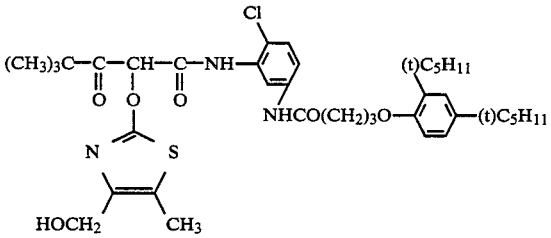

Y-4

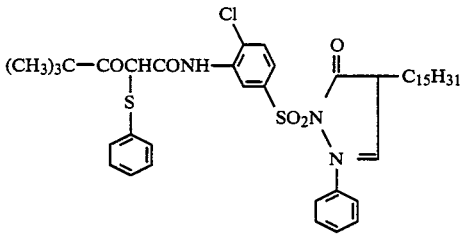

-continued

Y-5

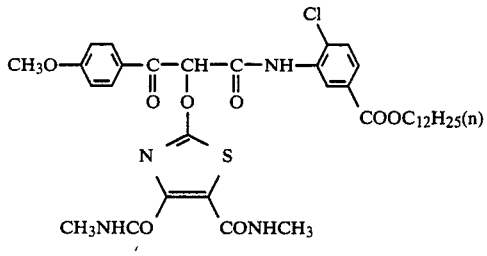

Y-6

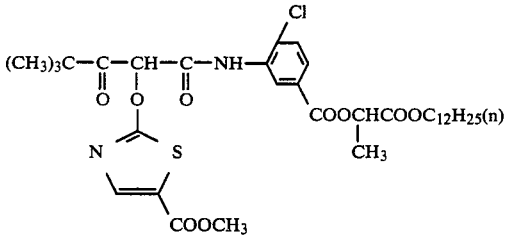

Y-7

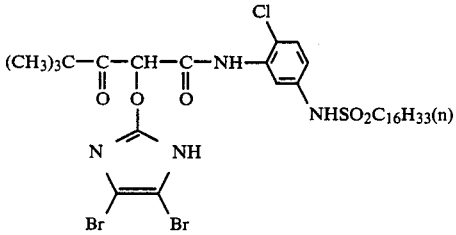

Y-8

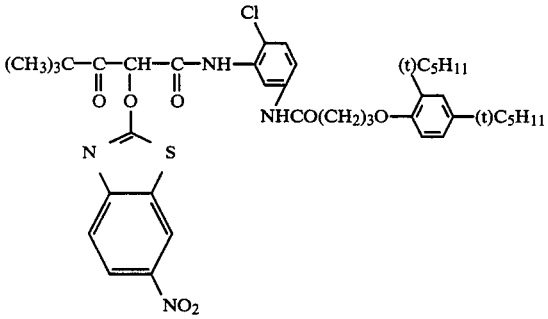

Y-9

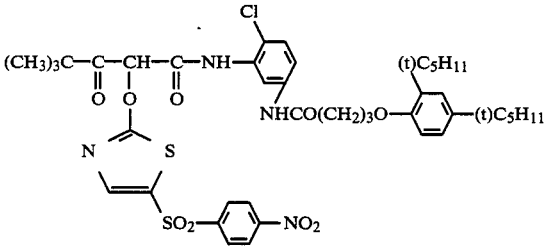

Y-10

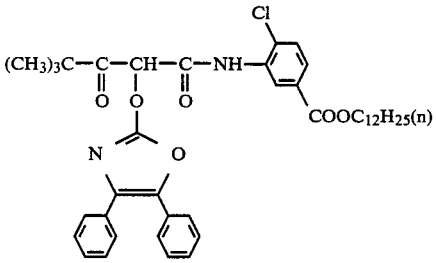

-continued
Y-11
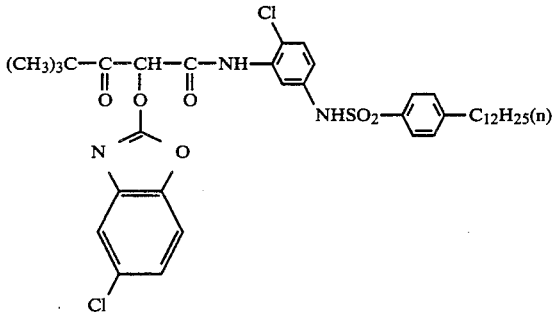
Y-12
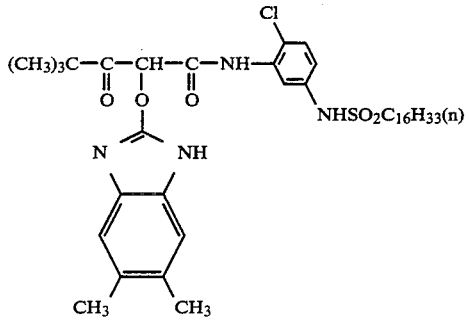
-continued
Y-13
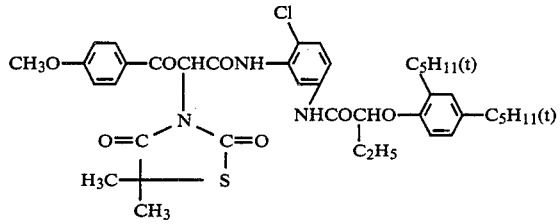
Y-14
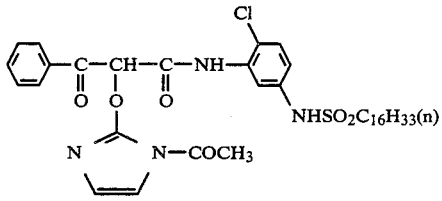
These yellow couplers may be prepared by any of the methods shown in Japanese Unexamined Published Patent Application Nos. 87650/1975, 131325/1976, 139333/1976, 43426/1977, 150631/1977, and U.S. Pat. Nos. 3,408,194 and 3,227,554.
Magenta couplers:
M-1
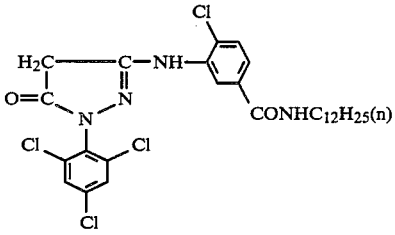
M-2
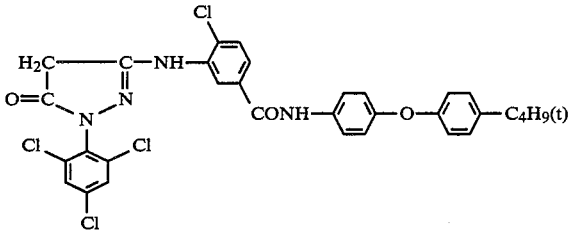
M-3
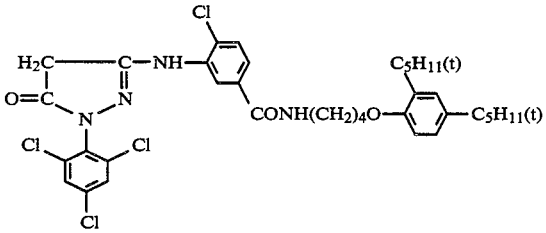
M-4
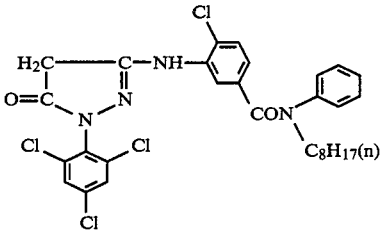
M-5
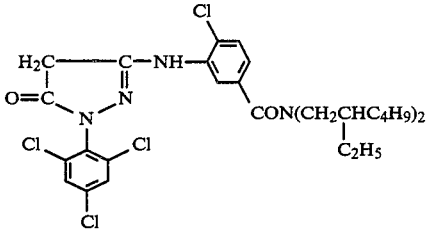
M-6
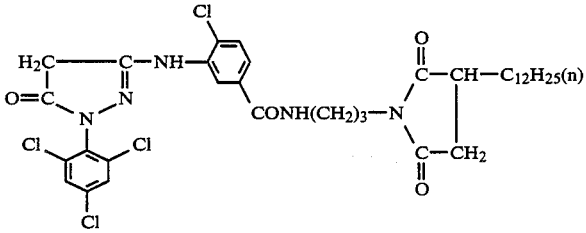

-continued
M-7
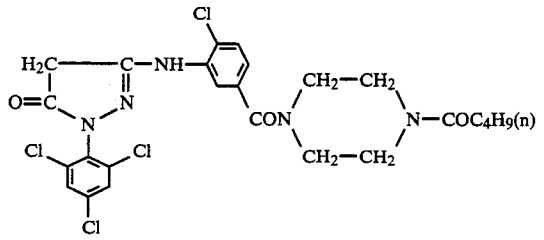
M-8
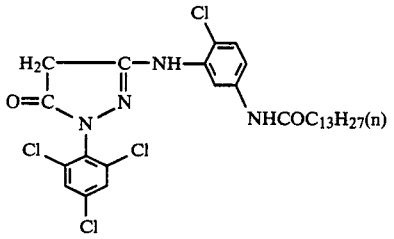
M-9
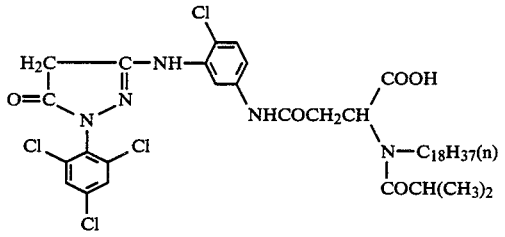
M-10
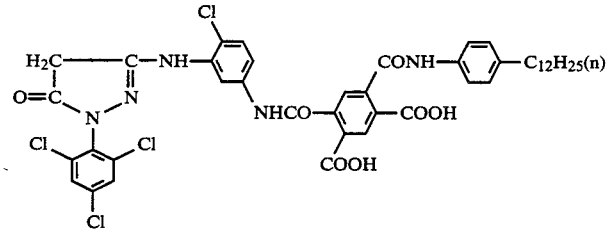
M-11
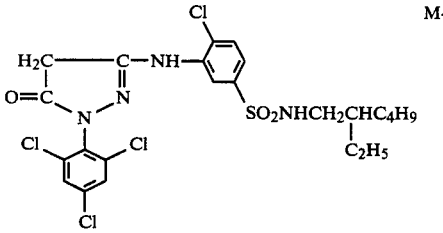
M-12
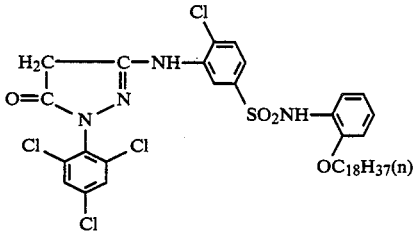
M-13
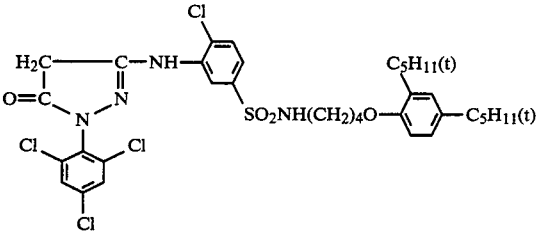
M-14
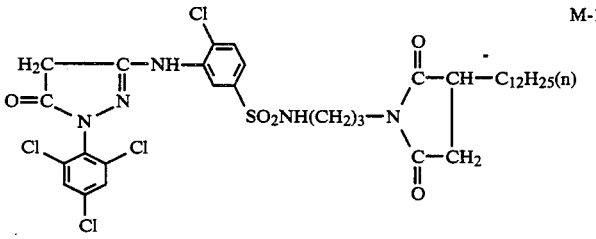
M-15
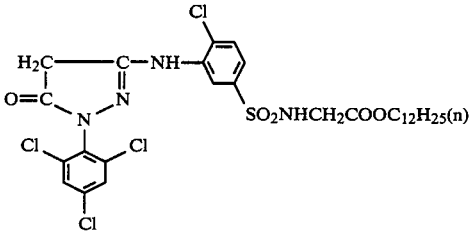
M-16
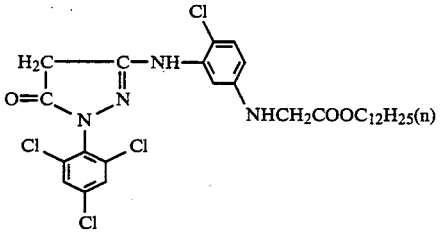
M-17
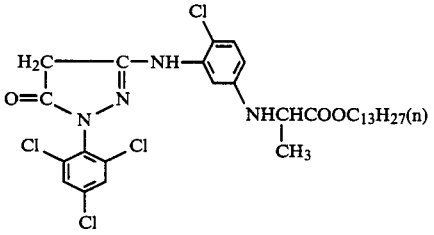

-continued
M-18
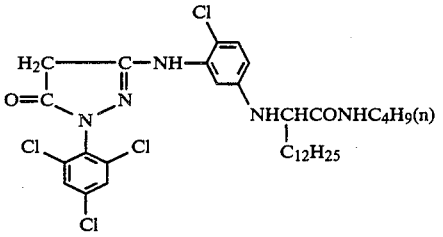
M-19
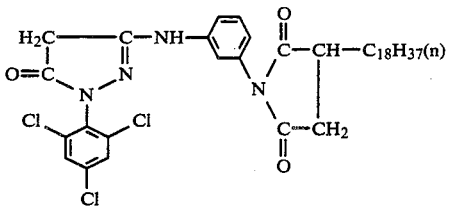
M-20
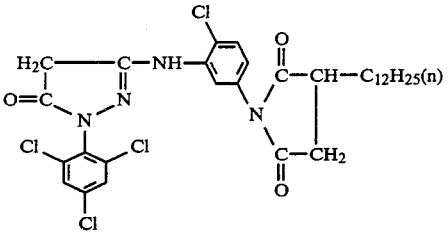
M-21
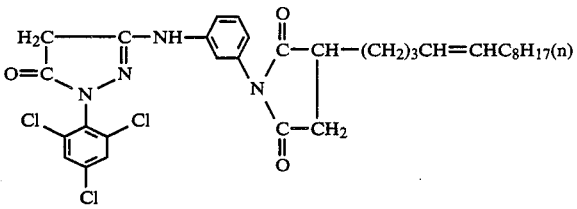
M-22
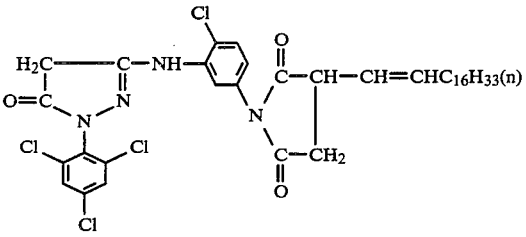
M-23
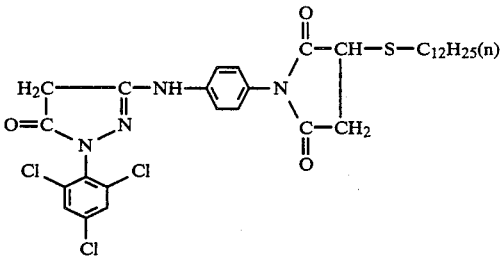
M-24
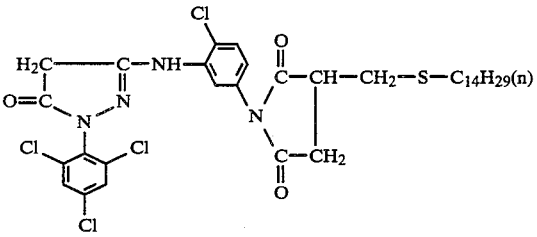
M-25
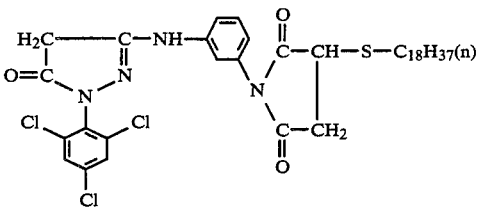
M-26
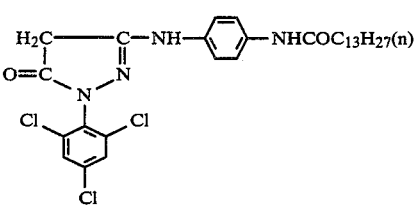
M-27
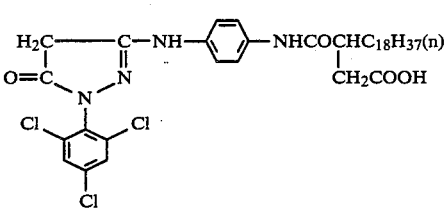
M-28
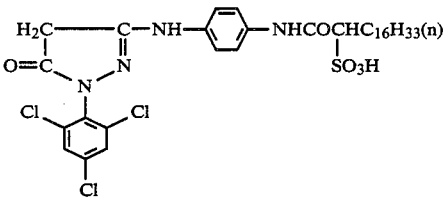
M-29
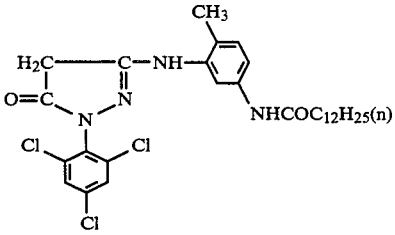

-continued
M-30
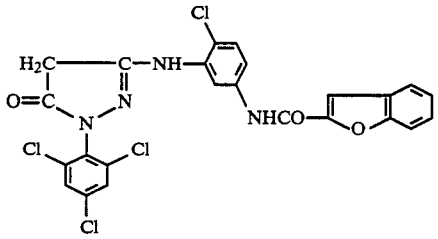
M-31
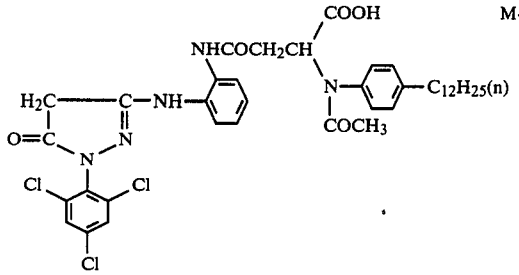
M-32
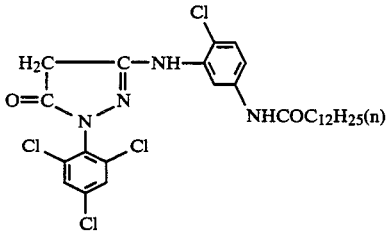
M-33
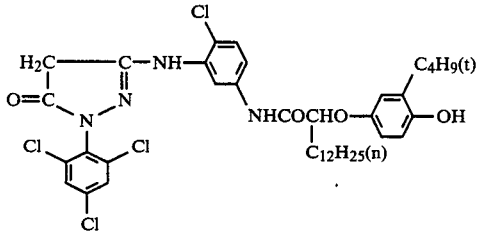
M-34
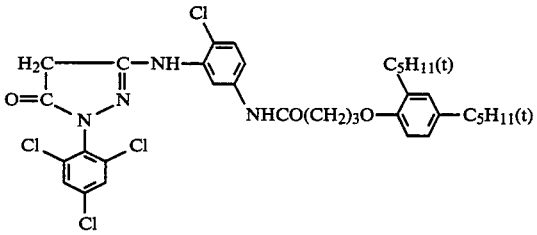
M-35
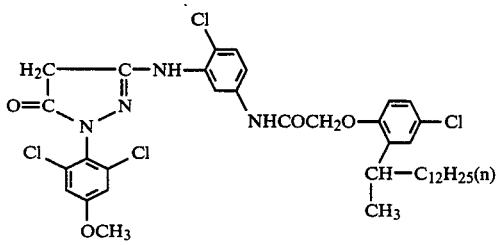
M-36
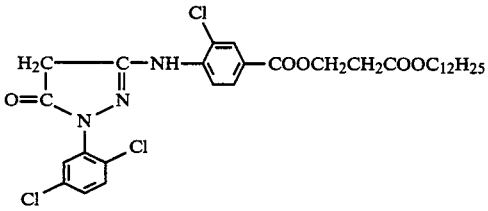
M-37
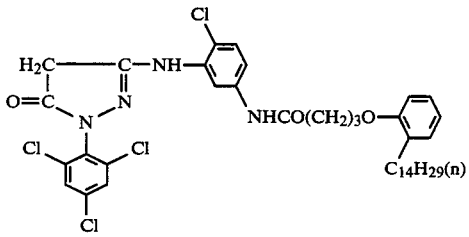
M-38
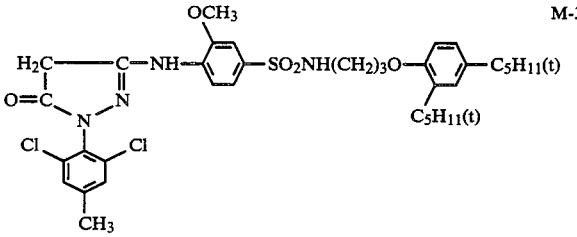
M-39
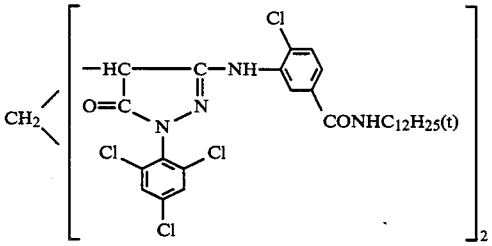
M-40
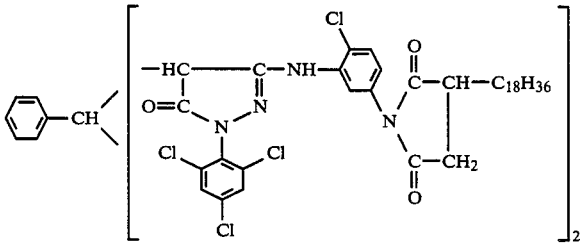

-continued

M-41

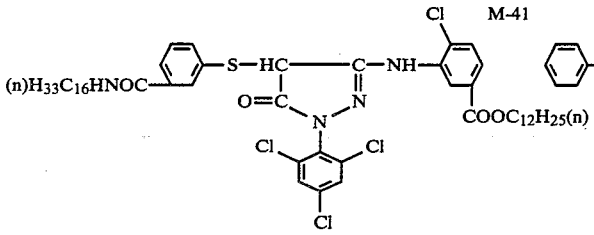

M-42

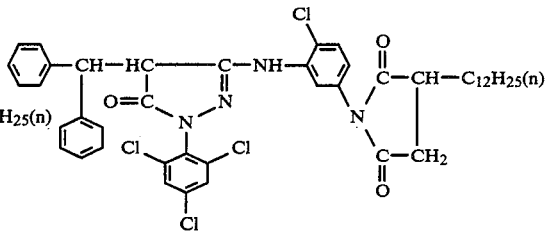

M-43

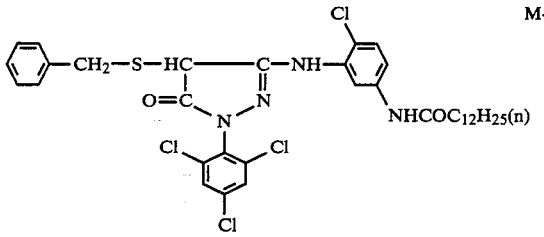

M-44

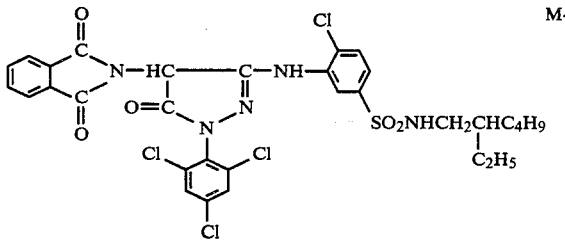

M-45

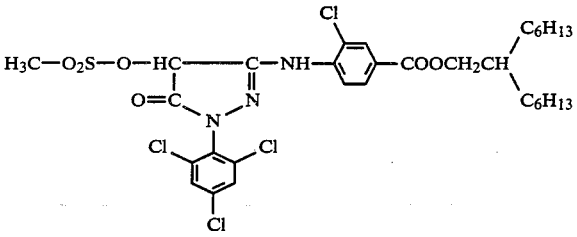

M-46

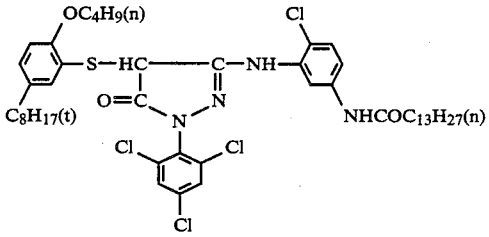

These magenta couplers may be prepared by any of the methods shown in U.S. Pat. No. 3,684,514, British Pat. No. 1,183,515, Japanese Patent Publication Nos. 6031/1965, 6035/1965, 15754/1969, 40757/1970, 19032/1971, Japanese Unexamined Published Patent Application Nos. 13041/1975, 129035/1978, 37646/1976 and 62454/1980. These magenta couplers may be used in combination with other known magenta couplers.

Each of these yellow and magenta dye forming couplers is incorporated in a silver halide emulsion layer in an amount of about 0.05–2 moles per mole of silver halide.

Examples of the support that can be used in the present invention include baryta paper, polyethylene coated paper, synthetic polypropylene paper, a transparent support with a reflective layer or a reflector, a polyester film such as made of cellulose acetate, cellulose nitrate or polyethylene terephthalate, a polyamide film, a polycarbonate film, and a polystyrene film. A suitable support is properly selected depending upon the specific use of the silver halide photographic material prepared in accordance with the present invention.

The silver halide emulsion layers and non-sensitive layers used in the present invention may be formed by any of the coating techniques including dip coating, air doctor coating, curtain coating and hopper coating.

Each of the silver halide emulsion layers according to the present invention may have incorporated therein any of the silver halides that are commonly employed in silver halide photographic materials, such as silver bromide, silver chloride, silver iodobromide, silver chlorobromide and silver chloroiodobromide. These silver halides may be used either as coarse or as fine grains, and the grain size distribution may be normal crystals ortwins, with the proportions of (100) and (111) planes being selected at suitable values. The crystals of the silver halide grains may have a homogeneous internal structure, or they may have different internal and surface structures. The silver halides may be of such a type that a latent image is principally formed on the surface or of such a type that the image is formed within the grain. Such silver halide grains may be prepared by either the neutral method, ammoniacal method or the acid method. Silver halide grains prepared by the double-jet method, single-jet method (either normal or reverse) or the conversion method.

The silver halide emulsions according to the present invention may be sensitized chemically. Chemical sensitizers that can be used in the present invention include sulfur sensitizers, selenium sensitizers, reduction sensitizers, and noble metal sensitizers. Illustrative sulfur sensitizers are arylthiocarbamide, thiourea, and cystine. Selenium sensitizers may be activated or inactive. Exemplary reduction sensitizers are stannous salts and polyamines. Usable noble metal sensitizers include gold sensitizers (e.g. potassium aurithiocyanate, potassium chloroaurate, and 2-aurosulfobenzothiazole methyl chloride) and water-soluble palladium, platinum, ruthenium, rhodium or iridium salts (e.g. ammonium chloropalladate, potassium chloroplatinate and sodium chloropalladide). These chemical sensitizers may be used either singly or in combination.

The silver halide emulsions according to the present invention may have various known photographic additives incorporated therein. Exemplary additives are shown in Research Disclosure No. 17643, December 1978.

The silver halides according to the present invention are spectrally sensitized with a suitable sensitizer in order to provide the red-sensitive emulsion with the necessary sensitivity in the proper spectral region. Various spectral sensitizers may be used either alone or in combination. Typical spectral sensitizers that can be used in the present invention with advantage are cyanine, merocyanine and composite cyanine dyes of the type shown in U.S. Pat. Nos. 2,269,234, 2,270,378, 2,442,710 and 2,776,280.

The silver halide emulsion layers and non-sensitive layers in the silver halide color photographic material of the present invention may contain various other photographic additives such as antifoggants, anti-stain agents, brighteners, antistats, hardeners, plasticizers, wetting agents and UV absorbers (preferably incorporated in non-sensitive layers) and these additives are illustrated in Research Disclosure No. 17643.

The silver halide photographic material thus prepared according to the present invention is exposed and subsequently processed photographically by various techniques of color development. The color developer preferred for use in the present invention contains an aromatic primary amine compound as the principal color developing agent. Typical color developing agents are p-phenylenediamine compounds, such as diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5-(N-ethyl-N-β-methanesulfonamidoethyl)aminotoluenesulfate, 4-(N-ethyl-N-β-methanesulfonamidoethylamino)aniline, 4-(N-ethyl-N-β-hydroxyethylamino)aniline and 2-amino-5-(N-ethyl-β-methoxyethyl)aminotoluene. These color developing agents may be used either alone or in combination. If necessary, they may be used in combination with a black-and-white developing agent such as hydroquinone. The color developer usually contains an alkali agent such as sodium hydroxide, ammonium hydroxide, sodium carbonate or sodium sulfite, and other additives such as an alkali metal halide (e.g. potassium bromide) and a development regulator (e.g. hydrazinic acid).

The color developing agent shown above that is present in a hydrophilic colloidal layer in the silver halide photographic material of the present invention may be incorporated as a precursor. The precursor is a compound that is capable of forming a color developing agent under alkaline conditions, and illustrative examples include a Schiff base with an aromatic aldehyde derivative, polyvalent metal ion complex, phthalylimide derivative, phosphorylamide derivative, sugar-amine reaction product, and urethane. More specific examples of the precursors for aromatic primary amine color developing agents are shown in U.S. Pat. Nos. 3,342,599, 2,507,114, 2,695,234, 3,719,492, British Pat. No. 803,783, Japanese Unexamined Published Patent Application Nos. 135,628/1978, 79,035/1979, as well as Research Disclosure No. 15,159, 12,146 and 13,924.

Such aromatic primary amine color developing agents or precursors therefor must be incorporated in amounts sufficient to provide adequate color formation during development. While the exact amount varies with the specific type of the photographic material to be processed, 0.1–5 moles, preferably 0.5–3 moles, of the color developing agent or its precursor are incorporated per mol of silver halide. The color developing agents and precursors therefor shown above may be used either alone or in combination. The compounds listed above may be incorporated in a photographic material after they are dissolved in a suitable solvent such as water, methanol, ethanol or acetone. Alternatively, a high-boiling organic solvent such as dibutyl phthalate, dioctyl phthalate or tricresyl phosphate may be used to form an emulsion of the compound, which is then incorporated in the photographic material. If desired, a latex polymer impregnated with the compound may be incorporated as shown in Research Disclosure No. 14850.

After color development, the silver halide color photographic material of the present invention is usually bleached, fixed (sometimes bleach-fixed in a single step) and rinsed with water. While many compounds are used as bleaching agents, compounds of polyvalent metals such as iron (III), cobalt (III) and tin (II) are preferred. Particularly suitable compounds are complex salts of such polyvalent cationic metals and organic acids, such as metal complex salts with aminopolycarboxylic acids (e.g. ethylenediaminetetraacetic acid, nitrilotriacetic acid, and N-hydroxyethylethylenediamine diacetic acid), malonic acid, tartaric acid, malic acid, diglycolic acid and dithioglycolic acid, as well as ferricyanate and bichromate salts. These compounds may be used either alone or in suitable combinations.

The silver halide photographic material of the present invention is capable of producing dye images that are highly resistant to heat and moisture (satisfactory resistance to dark discoloration) and which undergoes a minimum degree of visible yellow stain under light. This photographic material exhibits good color formation even if it is processed with a non-polluting color developer (i.e., free of benzyl alcohol). If the photographic material of the present invention is used in multi-color photography, definite improvements are achieved in the overall keeping quality of dye images since minimum stain occurs in the white background and the cyan, magenta and yellow colors produced are resistant to light, moisture and heat, and ensure a good balance between dark discoloration and light discoloration.

The advantages of the present invention are hereunder described in greater detail by reference to working examples, to which the scope of the present invention is by no means limited.

EXAMPLE 1

Multi-color photographic elements were prepared by forming the following layers on a support made of polyethylene coated paper, with the first layer positioned closest to the support.

First Layer

A yellow coupler containing blue-sensitive silver chlorobromide (85 mol% silver bromide) emulsion layer coated to give a gelatin deposition of 2 g/m$^2$; this layer contained 300 g of gelatin per mol of silver halide, as well as 0.5 mol, per mol of silver halide, of a yellow coupler (Y-1) which was dispersed as a dibutyl phthalate solution.

Second Layer

First intermediate layer (gelatin layer with a gelatin deposition of 1.5 g/m$^2$).

Third Layer

A magenta coupler containing green-sensitive silver chlorobromide (70 mol% silver bromide) emulsion layer coated to give a gelatin deposition of 2 g/m$^2$; this layer contained 400 g of gelatin per mol of silver halide, as well as 0.3 mol, per mol of silver halide, of a magenta coupler (M-22) that was dispersed as a dibutyl phthalate solution.

Fourth Layer

Second intermediate layer containing a UV absorber; in this layer, UV absorber, UV-1 shown below, was dispersed in gelatin as a solution in 20 g of dibutyl phthalate, and its coating thickness was such that the UV absorber and gelatin deposits were 0.6 g/m$^2$ and 1.5 g/m$^2$, respectively.

Fifth Layer

A cyan coupler containing red-sensitive silver chlorobromide (70 mol% silver bromide) emulsion layer coated to give a gelatin deposit of 2 g/m$^2$; this layer contained 300 g of gelatin per mol of silver halide, as well as 0.4 mol, per mol of silver halide, of one of the cyan couplers in Table 1 or comparative cyan couplers C-A, C-B and C-C shown below, which were dispersed as a dibutyl phthalate solution having a dielectric constant of 6.4; in half of the samples, 0.14 g of dye compound (II-27) and 0.2 g of (III-1) were contained as dissolved in 20 ml of water.

Sixth Layer

Protective layer (gelatin layer with a gelatin deposit of 1.5 g/m$^2$).

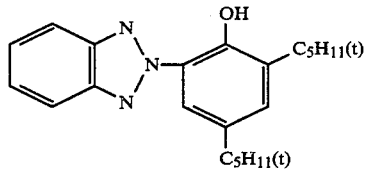

(UV - 1)

Sample Nos. 1 to 12 thus prepared were exposed with a sensitometer (Model KS-7 of Konishiroku Photo Industry Co., Ltd.). In order to produce monochromatic (cyan) images, the samples were exposed through an optical wedge. The exposed samples were subjected to the following steps.

| Treatments | Temperature | Period |
|---|---|---|
| Color development | 32.8° C. | 3 min and 30 sec |
| Bleach-fixing | 32.8° C. | 1 min and 30 sec |
| Washing | 32.8° C. | 3 min and 30 sec |

The following formulations were used in the steps of color development and bleach-fixing.

| Components | Amount |
|---|---|
| Color developer A | |
| 4-Amino-3-methyl-N—ethyl-N—(β-methanesulfonamidoethyl)-aniline sulfate | 5.0 g |
| Benzyl alcohol | 15 ml |
| Sodium hexametaphosphate | 2.5 g |
| Anhydrous sodium sulfite | 1.85 g |
| Sodium bromide | 1.4 g |
| Potassium bromide | 0.5 g |
| Borax | 39.1 g |
| Water to make | 1,000 ml |
| pH adjusted to 10.3 with sodium hydroxide | |
| Bleach-fixing solution | |

-continued

| Components | Amount |
|---|---|
| Ethylenediaminetetraacetic sodium iron (III) salt | 61.0 g |
| Ethylenediaminetetraacetic acid diammonium salt | 5.0 g |
| Ammonium thiosulfate | 124.5 g |
| Sodium metasulfite | 13.5 g |
| Anhydrous sodium sulfite | 2.7 g |
| Water to make | 1,000 ml |

Another group of the same samples were processed with color developer B having the same composition as that of developer A except that the former contained no benzyl alcohol. The samples were checked for their color formation as shown below.

The group of samples processed by color developer A were subjected to the following tests for the purpose of checking the stability of the images.

Dye Image Keeping Quality Test

(1) Y stain under light

The samples were mounted in an outdoor weather-Ometer (Suga Test Instruments Co., Ltd.) and the background was exposed to sunlight for 30 days. The whiteness of the background was evaluated by the L*-a*-b* color indication system. The a* and b* values of each sample, which related to the chromaticness shown in Japanese Unexamined Published Patent Application No. 93150/1980, were measured by the method specified in JIS Z 8722.

(2) Dark discoloration

The samples were left to stand in the dark in a constant-temperature chamber (70° C.) for 14 days, and the percent residual dye for the initial density of 1.0 in each sample was determined.

Color Formability Test

The color formation in the samples processed by color developer B was evaluated in accordance with the formula:

$$\frac{\text{max. transmission density obtained by processing with color developer } B}{\text{max. transmission density obtained by processing with color developer } A} \times 100$$

The results of these tests are shown in Table 1.

(Comparative coupler A)

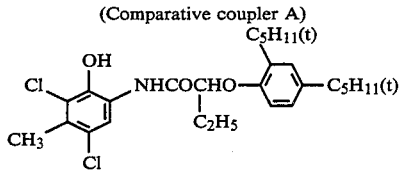

(Comparative coupler B)

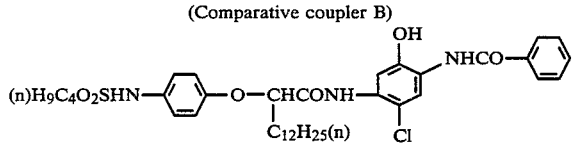

(Comparative coupler C)

-continued

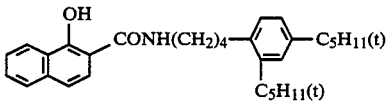

TABLE 1

| Sample No. | Cyan coupler | Dye | Color formation (%) | Y stain a* | Y stain b* | Light discoloration |
|---|---|---|---|---|---|---|
| 1 | Comparative coupler (A) | — | 62 | −1.8 | +12.2 | 61 |
| 2 | Comparative coupler (A) | II-27 III-1 | 62 | −1.7 | +11.9 | 61 |
| 3 | Comparative coupler (B) | — | 68 | −2.3 | +17.5 | 99 |
| 4 | Comparative coupler (B) | II-27 III-1 | 69 | −2.2 | +17.1 | 99 |
| 5 | Comparative coupler (C) | — | 65 | −2.2 | +15.8 | 63 |
| 6 | Comparative coupler (C) | II-27 III-1 | 64 | −2.1 | +15.3 | 64 |
| 7 | (I-1) | — | 92 | −1.9 | +12.3 | 99 |
| 8 | " | II-27 III-1 | 92 | −0.3 | +6.2 | 100 |
| 9 | (I-4) | — | 89 | −2.0 | +12.7 | 99 |
| 10 | " | II-27 III-1 | 90 | −0.4 | +6.7 | 99 |
| 11 | (I-8) | — | 89 | −2.0 | +12.6 | 100 |
| 12 | " | II-27 III-1 | 89 | −0.3 | +6.4 | 99 |

The dyes according to the present invention were little effective in the samples using comparative couplers (A), (B) or (C); they had high b* values, indicating the high visibility of yellow stain, and the color formation with a benzyl alcohol free developer was not good enough to comply with the purposes of the present invention. On the other hand, the samples using the couplers in accordance with the present invention exhibited good color formation even when they were processed with a benzyl alcohol free color developer. Sample Nos. 8, 10 and 12 which also contained the dyes in accordance with the present invention had b* values about half the values for sample Nos. 7, 9 and 11 which contained no such dyes. This is a visual proof of the fact that the background of each of sample Nos. 8, 10 and 12 remained satisfactorily white even after exposure to light.

EXAMPLE 2

Three samples of silver halide photographic material were prepared as in Example 1 using the cyan coupler I-1 and the dyes shown in Table 2, except that the sixth layer was under-laid with a UV layer whose gelatin doposit was half the amount used in the fourth layer. The samples were subjected to the same tests as in Example 1. The results are shown in Table 2.

TABLE 2

| Sample No. | Cyan coupler | Dye | Color formation (%) | Y stain a* | Y stain b* | Light discoloration |
|---|---|---|---|---|---|---|
| 13 | (I-1) | II-19 II-21 | 92 | −0.4 | +4.5 | 100 |
| 14 | " | II-18 II-20 | 91 | −0.5 | +4.3 | 99 |
| 15 | " | II-21 | 91 | −1.2 | +4.8 | 100 |

As Table 2 shows, sample No. 15 using only one dye (II-21) was a bit less effective in providing resistance to Y stain then sample Nos. 13 and 14 using two dyes. However, all three samples having a UV absorbing layer above the cyan coupler containing layer were more effective in achieving the objects of the present invention than the samples prepared in Example 1.

What is claimed is:

1. A silver halide photographic material having one or more silver halide emulsion layers formed on a reflective support, wherein at least one of said silver halide emulsion layers contains at least one cyan coupler of formula (I) dispersed therein with the aid of at least one high-boiling organic solvent having a dielectric constant of 6.1 or more, and wherein at least one photographic layer contains at least one dye of formula (II) and/or formula (III):

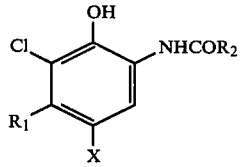

(I)

(wherein $R_1$ is a straight- or branched-chain alkyl group having 2 to 4 carbon atoms; $R_2$ is a ballast group; and X is a hydrogen atom or a group capable of leaving upon coupling reaction with the oxidized product of a color developing agent);

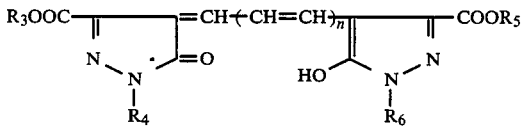

(II)

(wherein $R_3$ and $R_5$ are each a hydrogen atom, an alkyl group or an aryl group; $R_4$ and $R_6$ are each an aryl group or a hetero ring having at least one sulfonic acid group or carboxyl group either directly of via an alkylene group having 1 to 4 carbon atoms; and n is an integer of 0, 1 or 2);

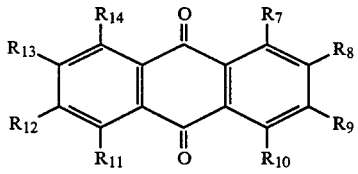

(III)

[wherein $R_7$, $R_{10}$, $R_{11}$ and $R_{14}$ are each a hydrogen atom, a hydroxyl group, —OR (wherein R is alkyl or aryl),

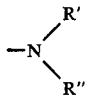

(wherein R' and R'' are each a hydrogen atom or an alkyl or aryl group having at least one sulfonic acid group or carboxyl group); $R_8$, $R_9$, $R_{12}$ and $R_{13}$ are each a hydrogen atom, a sulfonic acid group, a carboxyl group, or an alkyl or aryl group having at least one sulfonic acid group or carboxyl group].

2. A silver halide photographic material according to claim 1, wherein said at least one high-boiling organic solvent is one represented by the following formula (IV) or (V):

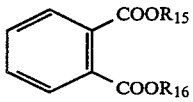

(IV)

(wherein $R_{15}$ and $R_{16}$ are each an alkyl group having 1 to 4 carbon atoms);

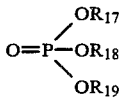

(V)

(wherein $R_{17}$, $R_{18}$ and $R_{19}$ are each an alkyl group having 1 to 4 carbon atoms or an aryl group).

3. A silver halide photographic material according to claim 1, wherein $R_1$ in said formula (I) is an ethyl group.

4. A silver halide photographic material according to claim 1, wherein $R_2$ in said formula (I) is a ballast group represented by the following formula:

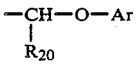

(wherein $R_{20}$ is a hydrogen atom or an alkyl group having 1 to 12 carbon atoms; and Ar is an aryl group).

5. A silver halide photographic material according to claim 1, wherein the alkyl group represented by $R_3$ and $R_5$ of said formula (II) has 1 to 4 carbon atoms.

6. A silver halide photographic material according to claim 1, which comprises, in sequence from the support, a yellow coupler-containing blue-sensitive silver halide emulsion layer, a magenta coupler-containing green-sensitive silver halide emulsion layer and a cyan coupler-containing red-sensitive silver halide emulsion layer.

* * * * *